US006065527A

United States Patent [19]

Poran et al.

[11] Patent Number: 6,065,527

[45] Date of Patent: May 23, 2000

[54] SYNCHRONIZED OSCILLATOR FOR CONTINUOUS CASTING APPARATUS

[75] Inventors: Michael Poran, Westwood, N.J.; Anthony E. Scotto, Pittsburgh, Pa.

[73] Assignee: SMS Concast Division of SMS Schloemann-Siemag Inc., Pittsburgh, Pa.

[21] Appl. No.: 09/092,535

[22] Filed: Jun. 5, 1998

[51] Int. Cl.[7] ..... B22D 11/053

[52] U.S. Cl. ..... 164/478; 164/416

[58] Field of Search ..... 164/416, 478

[56] References Cited

U.S. PATENT DOCUMENTS

| | | | |
|---|---|---|---|
| 3,293,707 | 12/1966 | Olsson | 164/478 |
| 4,057,099 | 11/1977 | Danieli | 164/416 |
| 4,263,960 | 4/1981 | Colombo | 164/416 |
| 4,532,975 | 8/1985 | Ives | 164/416 |
| 4,953,613 | 9/1990 | Schumers | 164/416 |

FOREIGN PATENT DOCUMENTS

| | | | |
|---|---|---|---|
| 1957232 | 5/1971 | Germany | 164/416 |

*Primary Examiner*—Kuang Y. Lin
*Attorney, Agent, or Firm*—Antonio R. Durando

[57] ABSTRACT

A mold table for the continuous casting of large strands has two separate parts. The mold table parts are coupled to opposite ends of an elongated rigid rotatable member by respective linkages. A drive oscillates the rotatable member which, in turn, constrains the mold table parts to oscillate synchronously.

24 Claims, 4 Drawing Sheets

SYNCHRONIZED OSCILLATOR FOR CONTINUOUS CASTING APPARATUS

BACKGROUND OF THE INVENTION

1. Field of the Invention

The invention relates to a continuous casting apparatus.

2. Description of the Prior Art

During a continuous casting operation, molten material is teemed into a cooled mold where the material is at least partially solidified to form a continuously cast strand. The mold, which is oscillated during continuous casting, is supported by a mold table driven by an oscillator.

In a continuous casting apparatus for the casting of wide products, e.g., slabs having a width greater than 60 inches, the mold table consists of two parts which are spaced from one another. For proper operation, the mold table parts must be oscillated synchronously.

One conventional system for oscillating the mold table parts employs two eccentrics. Each of the eccentrics acts on a push rod which, in turn, is coupled to one of the mold table parts. The push rods have adjustable lengths to permit leveling of the mold table parts. A gear mechanism is located between the eccentrics, and two shafts connect the gear mechanism to the respective eccentrics. The gear mechanism is driven by an electric motor.

This electromechanical oscillating system is associated with substantial difficulties arising from the fact that the two mold table parts must be oscillated in synchronism. To begin with, all elements of the drive system, including the eccentrics, couplings, bushings and keyways, must be machined with a high degree of precision. Furthermore, all elements of the drive system must be very accurately aligned. Aside from these difficulties, the cost of the system is high because the system is complex and two eccentrics are required.

Another conventional oscillating system employs two hydraulic cylinder-and-piston units which are coupled to respective ones of the mold table parts. The hydraulic units, which extend and retract to generate an oscillating motion, are supplied with hydraulic fluid from a common reservoir.

The need for synchronous movement of the mold table parts creates substantial problems for the hydraulic system also. The hydraulic units must not only be machined with a high degree of precision but must be equipped with electronic position feedback sensors and a very complex servo mechanism. Moreover, excellent tuning and continuous readjustments are required. Additionally, this system is expensive because considerable maintenance is necessary and two cylinder-and-piston units must be used.

SUMMARY OF THE INVENTION

It is an object of the invention to simplify systems for the synchronous oscillation of spaced parts of a mold carrier or table.

The preceding object, as well as others which will become apparent as the description proceeds, are achieved by the invention.

One aspect of the invention resides in a continuous casting apparatus. The apparatus comprises a mold carrier or table having two spaced parts, means for oscillating the mold carrier parts, and means for synchronizing movement of the mold carrier parts. The synchronizing means includes a synchronizing member which is mounted for movement as a unit and is coupled to the mold carrier parts.

The synchronizing member constrains the mold carrier parts to move as a unit, i.e., synchronously, since the synchronizing member is coupled to these parts and itself moves as a unit. This allows the mold carrier parts to be oscillated by a single oscillation generator, e.g., a single eccentric or single cylinder-and-piston unit, which acts on the synchronizing member or another member coupled to the mold carrier parts. A single oscillation generator eliminates the complexities arising from the use of a discrete oscillation generator for each mold part.

Another aspect of the invention resides in a method of oscillating a mold carrier having two spaced parts. The method comprises the steps of generating an oscillating motion at a predetermined location, and transferring the motion from such location to the mold carrier parts so that the latter oscillate substantially synchronously.

The method can further comprise the step of preventing substantial transfer of stresses due to thermal expansion of the mold carrier parts from the mold carrier parts to the predetermined location.

The step of transferring motion may include advancing the oscillating motion to the mold carrier parts by way of a synchronizing member mounted for movement as a unit and coupled to the mold carrier parts.

The oscillating motion is preferably generated at a location substantially midway between the mold carrier parts.

Additional features and advantages of the invention will be forthcoming from the following detailed description of preferred embodiments when read in conjunction with the accompanying drawings.

DESCRIPTION OF THE PREFERRED EMBODIMENTS

Figure 1:
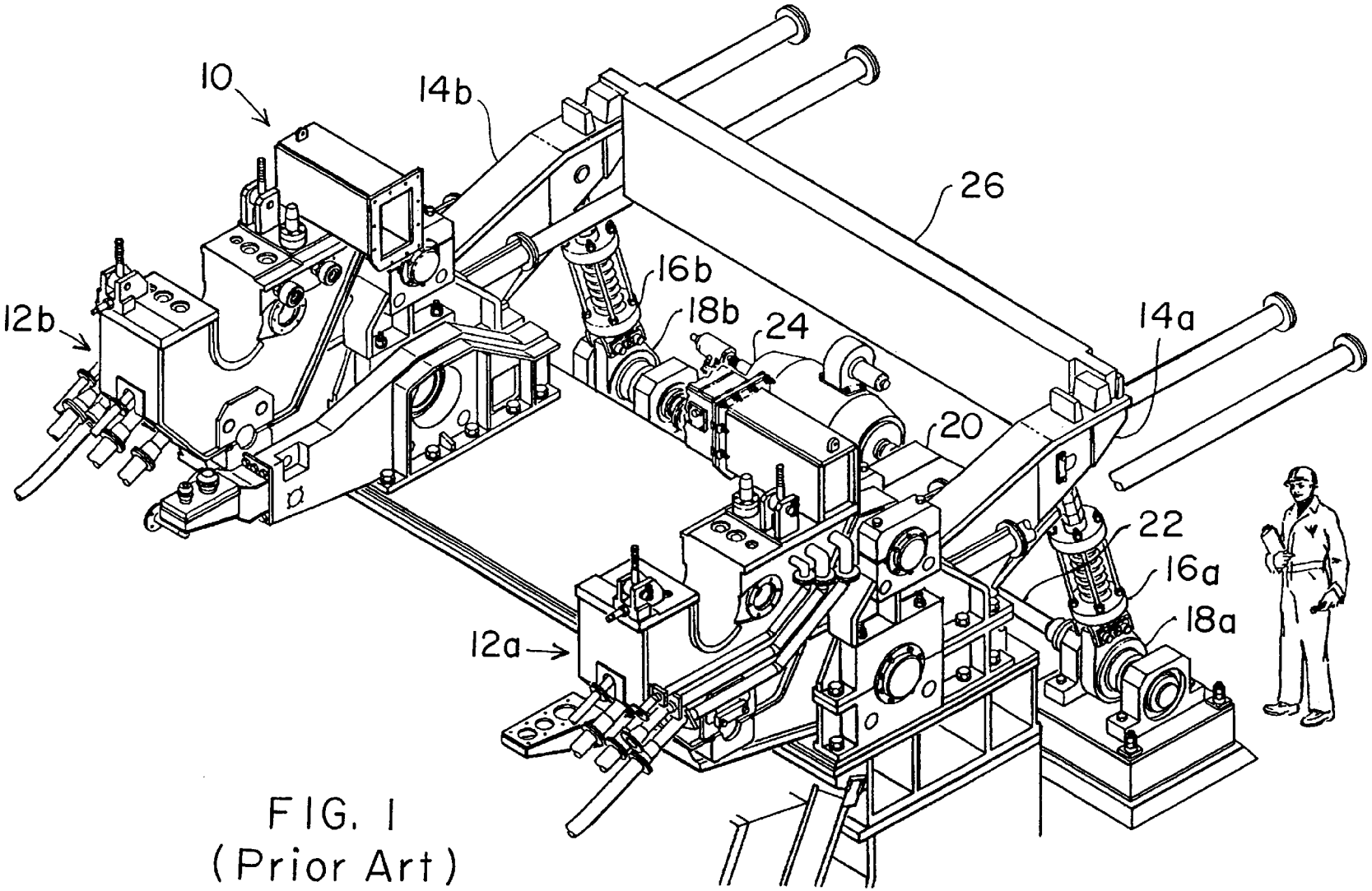
FIG. 1 (Prior Art)
FIG. 1 is a perspective view of a prior art system for oscillating a mold carrier having two spaced parts.

Referring to FIG. 1, the numeral 10 identifies a prior art system which constitutes part of a continuous casting apparatus and is used to oscillate or reciprocate a non-illustrated mold of the apparatus. The oscillating system 10 includes a mold table or carrier having two parts 12*a* and 12*b* which are spaced from one another. The mold table part 12*a* is mounted on a lever arm 14*a* and the mold table part 12*b* on a lever arm 14*b*.

A push rod or moving member 16*a* is connected to the mold table part 12*a* and a push rod or moving member 16*b* to the mold table part 12*b*. The push rod 16*a* is mounted on an eccentric mechanism 18*a* and the push rod 16*b* on an eccentric mechanism 18*b*. The eccentric mechanism 18*a* is coupled to a gear reducer 20 by a drive shaft 22 while the eccentric mechanism 18*b* is coupled to the gear reducer 20 by a second drive shaft not visible in FIG. 1. The gear reducer 20 is driven by an electric motor 24. A counterweight 26 suspended from the lever arms 14*a*,14*b* serves to reduce the power requirements of the motor 24.

When the motor 24 operates, the gear reducer 20 rotates the eccentric mechanisms 18*a*,18*b* by way of the drive shaft 22 and the second drive shaft. As the eccentric mechanisms 18*a*,18*b* rotate, the push rods 16*a*,16*b* are moved up-and-down. The push rods 16*a*,16*b* impart a seesaw motion to the lever arms 14*a*,14*b* which, in turn, oscillate the mold table parts 12*a*,12*b*.

The mold table parts 12*a*,12*b* must oscillate synchronously since otherwise the mold will wobble resulting in a variety of problems. However, as outlined previously, it is very difficult to achieve synchronous oscillation with the oscillating system 10. Thus, the eccentric mechanisms 18*a*, 18*b*, as well as the couplings, bushings and keyways which serve to support the eccentric mechanisms 18*a*,18*b* and to connect the latter to the gear reducer 20, must be machined and aligned with extreme accuracy. The oscillating system 10 is also costly because it is complex and requires two eccentric mechanisms 18*a*,18*b*.

In another prior art oscillating system, the push rods 16*a*,16*b* and eccentric mechanisms 18*a*,18*b* are replaced by hydraulic cylinder-and-piston units while the gear reducer 20 and motor 24 are replaced by a hydraulic fluid reservoir. This prior art hydraulic oscillating system likewise poses great challenges in attempting to achieve synchronous oscillation of the mold table parts 12*a*,12*b*. To begin with, the hydraulic cylinder-and-piston units must be machined with a high degree of precision. Furthermore, the hydraulic units must be equipped with electronic position feedback sensors and a complicated servo mechanism. In addition, the system requires excellent tuning and continuous readjustments. The system is, moreover, expensive since significant maintenance is necessary and two cylinder-and-piston units are required.

The invention intends to provide a simpler system for synchronously oscillating two mold table or mold carrier parts.

Figure 2:
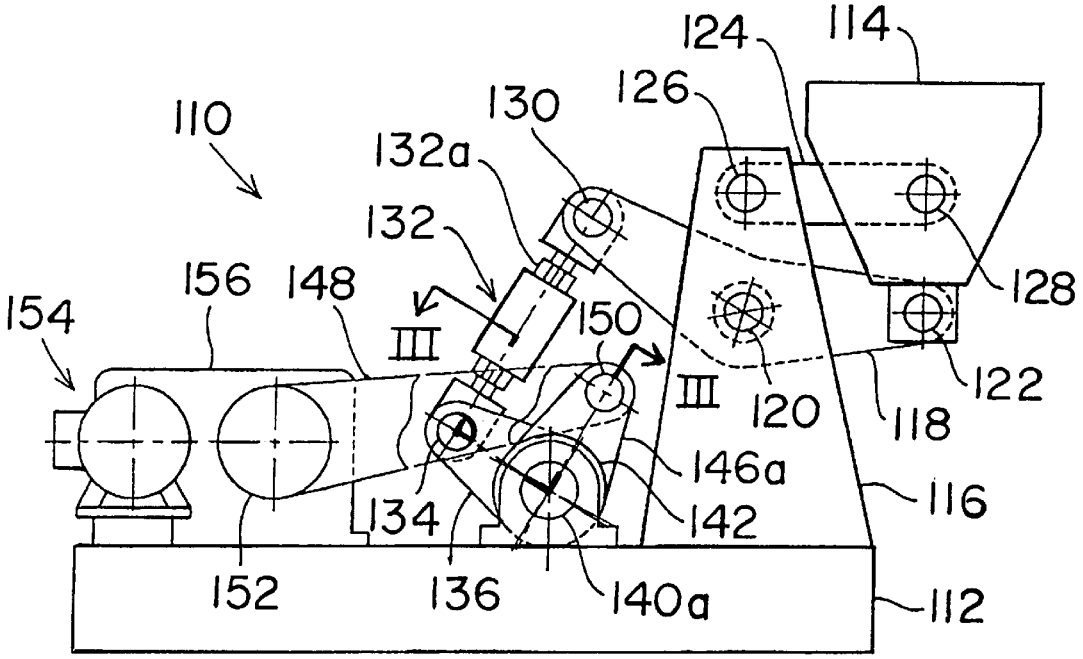
FIG. 2 is a side view of one embodiment of a system in accordance with the invention for oscillating a mold carrier having two parts.
Figure 3:
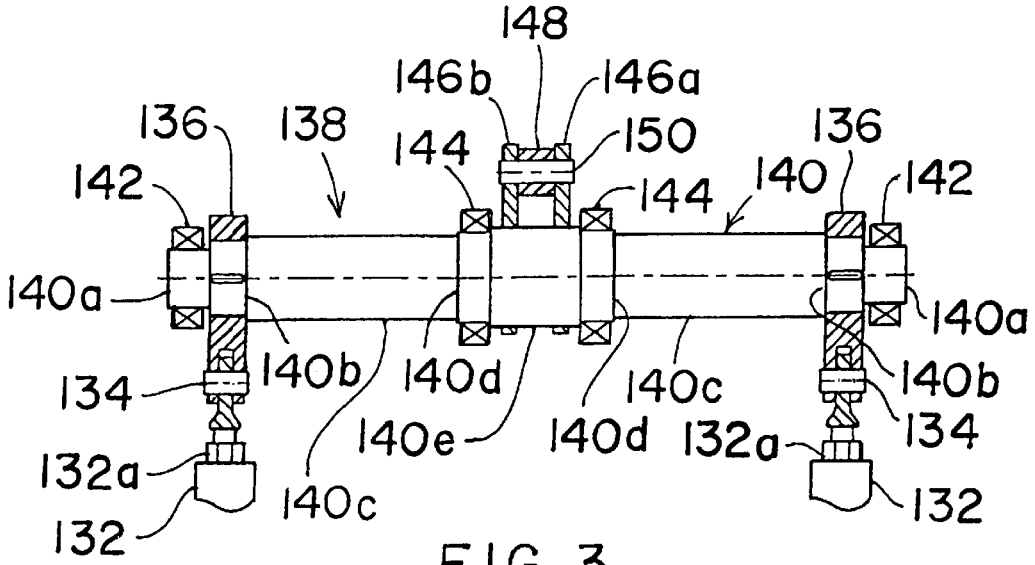
FIG. 3 is a sectional view along the line III—III of FIG. 2 with the visible components of the oscillating system spread apart for clarity.

FIGS. 2 and 3 illustrate one embodiment of an oscillating or reciprocating system in accordance with the invention. The oscillating system, which is denoted by the numeral 110, is supported on a foundation or base 112. The oscillating system 110 functions to oscillate or reciprocate a mold table or carrier having two parts 114 which are spaced from one another. Only one of the mold table parts 114 is visible.

The base 112 carries two spaced columns or pillars 116, and a lever arm 118 is pivotally mounted on each column 116 via a pivot 120. The pivots 120 are located between the ends of the lever arms 118. One end of each lever arm 118 is pivotally connected to a respective mold table part 114 by way of a pivot 122.

A stabilizing arm 124 is mounted on each column 116 above the respective lever arm 118. One end of each stabilizing arm 124 is pivotally connected to the respective column 116 via a pivot 126 while the other end is pivotally connected to the respective mold table part 114 via a pivot 128. The stabilizing arms 124 help to stabilize the mold table parts 114.

The end of each lever arm 118 remote from the respective mold table part 114 is pivotally connected, by means of a journal bearing 130, to one end of a push rod or moving member 132. The push rods 132 are adjustable, and the lengths of the push rods 132 can be fixed at any of a large number of values. To this end, the push rods 132 are provided with adjusting nuts 132*a*. The adjustability of the push rods 132 allows the mold table parts 114 to be leveled.

The end of each push rod 132 remote from the respective lever arm 118 is pivotally connected, via a journal bearing 134, to an operating level or member 136. Each of the operating levers 136 is fast with an elongated synchronizing member 138. The synchronizing member 138 includes a stepped synchronizing shaft or synchronizing element 140 having two end portions 140*a* of a first diameter, two anchoring portions 140*b* of a second diameter, two main portions 140*c* of a third diameter, two bearing portions 140*d* of a fourth diameter and a middle portion 140*e* of a fifth diameter. Each anchoring portion 140*b* is located between an end portion 140*a* and a main portion 140*c*, and each main portion 140*c* is located between an anchoring portion 140*b* and a bearing portion 140*d*. The bearing portions 140*d* are located between the middle portion 140*e* and the respective main portions 140*c*. The diameter of the middle portion 140*e* exceeds the diameter of the bearing portions 140*d*, and the diameter of the bearing portions 140*d* exceeds the diameter of the main portions 140*c*. Similarly, the diameter of the bearing portions 140*c* exceeds the diameter of the anchoring portions 140*b* which, in turn, exceeds the diameter of the end portions 140*a*.

The end portions 140*a* of the synchronizing shaft 140 serve as journals and are mounted for rotation in respective journal bearings 142. The bearing portions 140*d* of the synchronizing shaft 140 likewise function as journals and are respectively mounted for rotation in fixed bearings 144.

The anchoring portions 140*b* of the synchronizing shaft 140 serve as anchors for the operating levers 136. The operating levers 136 can, for instance, be keyed to the anchoring portions 140*b*.

In addition to the synchronizing shaft 140, the synchronizing member 138 includes an actuating handle or element. The actuating handle includes two plates or components 146*a* and 146*b* which are fast with the synchronizing shaft 140. The actuating handle 146*a*,146*b* is fixed to the middle portion 140*e* of the synchronizing shaft 140 and is angularly offset from the operating levers 136 circumferentially of the synchronizing shaft 140. In the illustrated embodiment, the actuating handle 146*a*,146*b* is offset 90 degrees from the operating levers 136 as seen in FIG. 2. The actuating handle 146*a*,146*b* is located midway between the lever arms 118.

The synchronizing member 138 rotates as a unit, that is, the synchronizing shaft 140 and actuating handle 146*a*,146*b* rotate in tandem.

The actuating handle 146*a*,146*b* is pivotally connected to one end of a push rod or drive member 148 by means of a pivot 150, and this end of the push rod 148 is received between the plates 146*a* and 146*b* of the actuating handle 146*a*,146*b*. The other end of the push rod 148 is connected to an eccentric 152 constituting a member for generating oscillating or reciprocating motion. The eccentric 152 is driven in rotation by an electric motor 154 via a gear reducer 156.

The operation of the oscillating system 110 is as follows:

The motor 154 is switched on and rotates the eccentric 152 by way of the gear reducer 156. The eccentric 152, which is connected to the push rod 148, reciprocates the push rod 148 longitudinally. As the push rod 148 reciprocates, the push rod 148 rotates the actuating handle 146*a*,146*b* back-and-forth on the axis of rotation of the synchronizing shaft 140.

Since the actuating handle 146*a*,146*b* is fast with the synchronizing shaft 140, the synchronizing shaft 140 rotates back-and-forth with the actuating handle 146*a*,146*b*. The synchronizing shaft 140, in turn, rotates the two operating levers 136 back-and-forth inasmuch as the operating levers 136, which are located at either end of the synchronizing shaft 140, are fixed to the latter. The back-and-forth motion of the operating levers 136 causes the two push rods 132, which are pivotally connected to the operating levers 136, to reciprocate longitudinally. Consequently, the two lever arms 118 pivotally connected to the respective push rods 132 are pivoted back-and-forth on the pivots 120. The ends of the lever arms 118 which are remote from the push rods 132 accordingly move up-and-down thereby synchronously oscillating the two mold table parts 114 mounted at such ends.

The oscillating system 110 allows the mold table parts 114 to oscillate in synchronism employing only the one eccentric 152 to generate an oscillating motion. By avoiding the use of two eccentrics as in the prior art oscillating system 10 of FIG. 1, the machining and alignment problems associated with the presence of two eccentrics are eliminated. The synchronizing member 138, which makes it possible to oscillate the two mold table parts 114 in synchronism using the single eccentric 152, also enables the oscillating system 110 of the invention to be considerably simplified as compared to the prior art oscillating system 10.

The journal bearings 130 joining the lever arms 118 to the push rods 132, the journal bearings 134 joining the push rods 132 to the operating levers 136, and the journal bearings 142 supporting the synchronizing shaft 140 allow the mold table parts 114 to undergo thermal expansion without affecting the actuating handle 146*a*,146*b* and the push rod 148.

Figure 4:
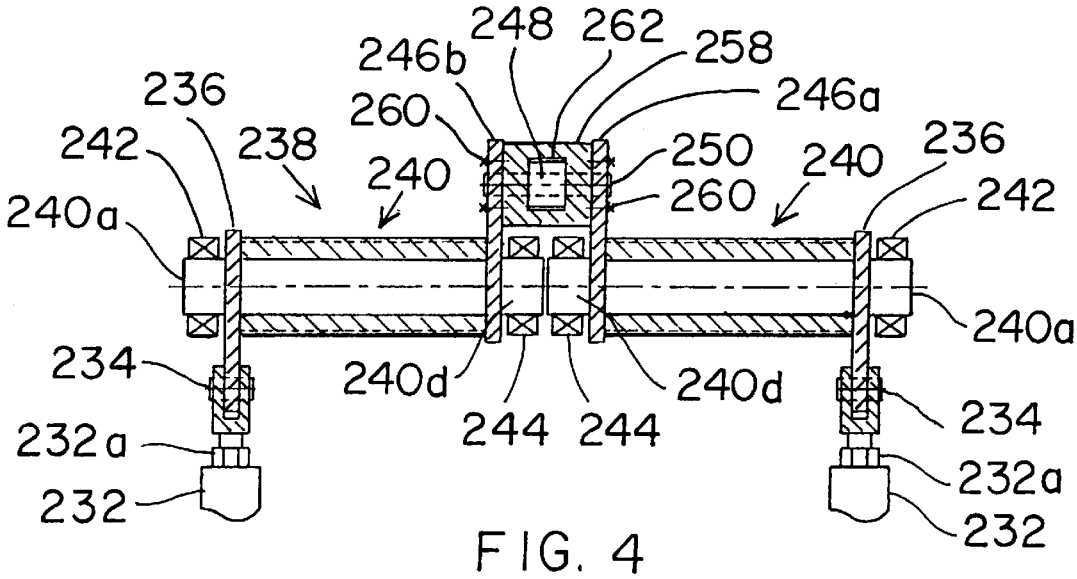
FIG. 4 is similar to FIG. 3 but illustrates another embodiment of an oscillating system according to the invention.

In FIG. 4, which shows another embodiment of the oscillating system of the invention, the same reference numerals as in FIGS. 2 and 3 plus 100 are used to identify similar elements.

The oscillating system of FIG. 4 differs from that of FIGS. 2 and 3 primarily in that the elongated synchronizing member 238 includes a pair of torque tubes 240 rather than a shaft such as the synchronizing shaft 140. One end of each torque tube 240 is provided with a journal 240*a* which rides in a respective journal bearing 242 while the other end of each torque tube 240 is provided with a journal 240*d* which rides in a respective fixed bearing 244. The fixed bearings 244 are situated between the two torque tubes 240.

One of the torque tubes 240 is further formed with a flange 246*a* and the other of the torque tubes 240 with a flange 246*b*. Each of the flanges 246*a*,246*b* adjoins the associated journal 240*d* and is located between the latter and the respective journal 240*a*. The flanges 246*a*,246*b* are in alignment, and a spacer 258 in the form of a block is disposed between the flanges 246*a*,246*b*. The flanges 246*a*, 246*b* abut the block 258, and each of the flanges 246*a*,246*b* is rigidly connected to the block 258 by bolts or fastening elements 260. A rigid connection is thus established between the two torque tubes 240. The block 258 functions to create and maintain a gap between the flanges 246*a*,246*b*, and the block 258 is designed so that the gap can accommodate the fixed bearings 244 for the journals 240*d*. The gap is sufficiently wide that the journals 240*d* can fit in the gap side-by-side without contacting one another.

The flanges 246*a*,246*b*, block 258 and bolts 260 together define an actuating handle or element corresponding to the actuating handle 146*a*,146*b* of FIGS. 2 and 3.

The block 258 is formed with an opening 262, and the push rod 248 projects through the opening 262 with clearance into the interior of the block 258. The pivot pin 250 pivotally connecting the push rod 248 to the actuating handle 246*a*,246*b*,258,260 passes through the flanges 246*a*, 246*b* and the block 258 into the push rod 248.

The synchronizing member 238, which comprises the torque tubes 240 and the actuating handle 246*a*,246*b*,258, 260, rotates as a unit. Thus, the torque tubes 240, flanges 246*a*,246*b*, block 258 and bolts 260 rotate in synchronism.

By replacing the synchronizing shaft 140 of solid cross section with the torque tubes 240, the weight of the synchronizing member 238 can be reduced. Moreover, the torque tubes 240 can have a relatively large diameter thereby enabling the flanges 246*a*,246*b* and the operating levers 236 to be easily and inexpensively welded to the torque tubes 240. In addition, the torque tubes 240 make it possible for the journal bearings 242 and the fixed bearings 244 to have the same size which allows costs to be reduced further.

Figure 5:
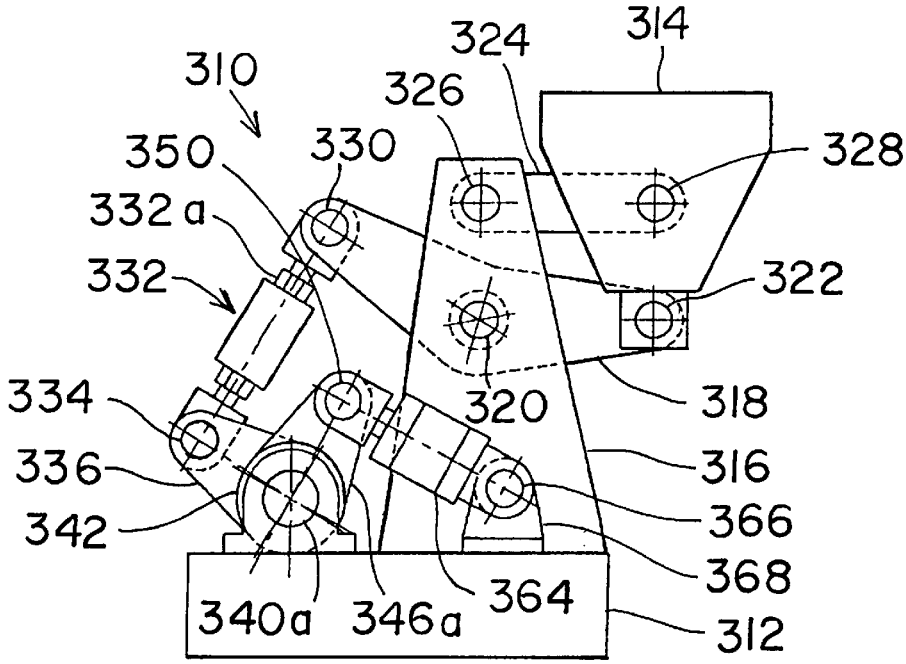
FIG. 5 is similar to FIG. 2 but shows an additional embodiment of an oscillating system in accordance with the invention.

FIG. 5, where the same reference numerals as in FIGS. 2 and 3 plus 200 are used to denote similar elements, illustrates an additional embodiment of the oscillating system of the invention.

The oscillating system 310 of FIG. 5 differs from that of FIGS. 2 and 3 mainly in that the electric motor 154, gear reducer 156, eccentric 152 and push rod 148 are replaced by a double-acting hydraulic cylinder-and-piston unit 364. The cylinder-and-piston unit 364, which is connected to a non-illustrated hydraulic fluid reservoir or source, constitutes a member for generating an oscillating or reciprocating motion. This motion is produced by alternately extending and retracting the cylinder-and-piston unit 364.

One end of the cylinder-and-piston unit 364 is pivotally connected to the actuating handle 346*a*,346*b* (346*b* not visible in FIG. 5) by the pivot 350. The other end of the cylinder-and-piston unit 364 is pivotally connected, by way of a pivot 366, to a bracket or pedestal 368 fixed to the foundation 312.

The cylinder-and-piston unit 364 can be used with the synchronizing member 238 of FIG. 4 as well as the synchronizing member 138 of FIGS. 2 and 3.

The oscillating system 310 of FIG. 5 permits the mold table parts 314 to be oscillated synchronously employing only the one cylinder-and-piston unit 364 to produce an oscillating motion. The use of the single cylinder-and-piston unit 364, rather than the two cylinder-and-piston units found in the prior art hydraulic oscillating systems, makes it unnecessary to machine the cylinder-and-piston unit 364 with the same degree of precision as the prior art cylinder-and-piston units. Moreover, the electronic position feedback sensors and complex servo mechanisms of the prior art hydraulic oscillating systems can be eliminated. The oscillating system 310 of FIG. 5 also does not require the fine tuning, continuous readjustment and high maintenance of these prior art systems.

Figure 7:
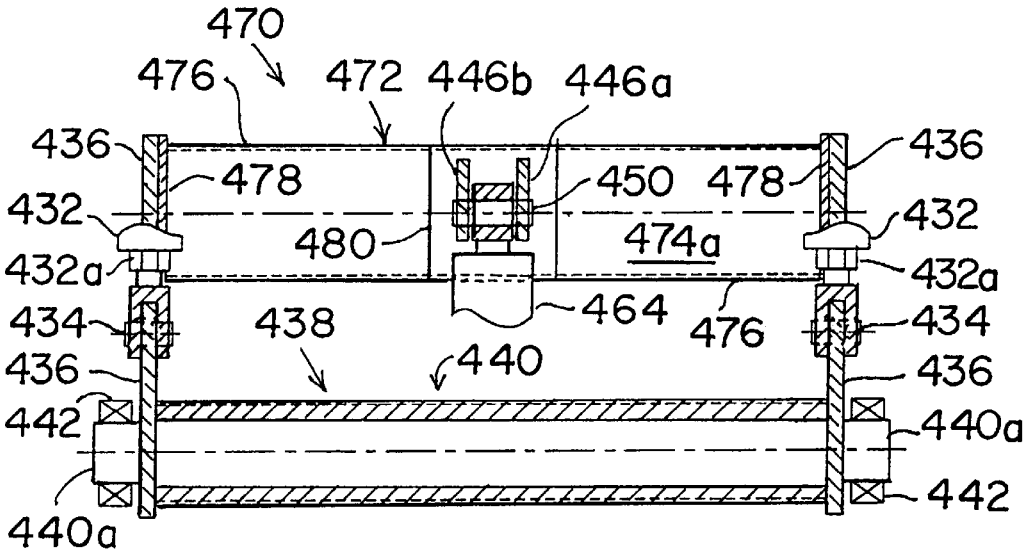
FIG. 7 is a sectional view along the line VII—VII of FIG. 6.
Figure 6:
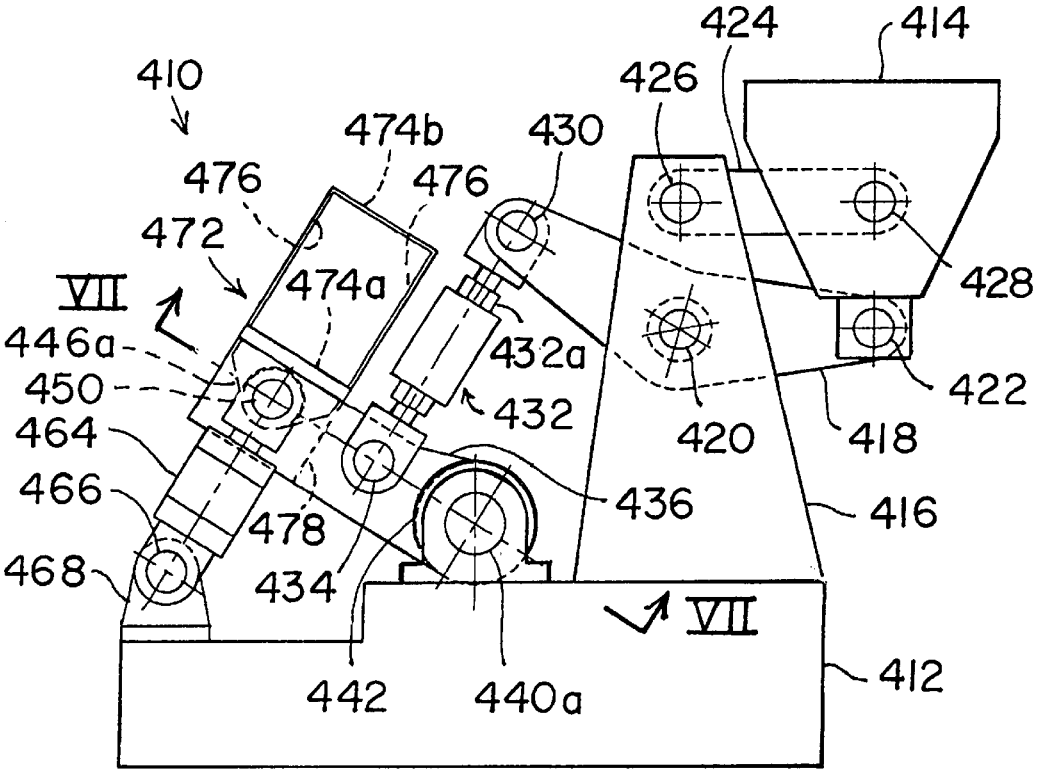
FIG. 6 is similar to FIGS. 2 and 5 but illustrates a further embodiment of an oscillating system according to the invention.

In FIGS. 6 and 7, where a further embodiment of the oscillating system of the invention is shown, the same reference numerals as in FIGS. 2 and 3 plus 300, or the same reference numerals as in FIG. 5 plus 100, are used to identify similar elements.

The synchronizing member 438 of FIGS. 6 and 7 consists of a single torque tube 440 which is provided with a journal 440*a* at either end. The journals 440*a* are supported for rotation in the journal bearings 442.

An elongated load-bearing or bridge member 470 extends in parallelism with the synchronizing member 438 at a spacing therefrom. The load-bearing member 470 includes a tie beam or element 472 in the form of a tube. The tube 472 is rectangular and has two opposed parallel narrow walls 474*a* and 474*b* as well as two opposed parallel wide walls 476. The tube 472 is disposed to the side of the push rods 432 remote from the synchronizing member 438, and the tube 472 is arranged with one of the wide walls 476 facing the push rods 432 and with the narrow wall 474*a* facing the foundation 412. The tube 472 is inclined in such a manner that the wide walls 476 are parallel to the push rods 432 and the narrow walls 474*a*,474*b* are perpendicular to the push rods 432. However, the tube 472 need not be so inclined.

The ends of the tube 472 are closed by rectangular plates or walls 478 which are fast with the tube 472, and the end plates 478 project beyond the narrow tube wall 474*a* towards the foundation 412. The operating levers 436 project to the side of the push rods 432 remote from the synchronizing member 438, and the projecting part of each lever 436 is rigidly connected to the projecting part of a respective end plate 478.

A reinforcing plate or element 480 is mounted on the narrow tube wall 474*a* at the middle of the tube 472. Two lugs or plates 446*a* and 446*b* are located beneath the reinforcing plate 480 and are rigidly fixed thereto. The lugs 446*a*,446*b* together constitute an actuating handle or element such as the actuating handle 146*a*,146*b* of FIG. 1. The lugs 446*a*,446*b* are arranged side-by-side with spacing to define a gap, and one end of the hydraulic cylinder-and-piston unit 464 extends into the gap. This end of the cylinder-and-piston unit 464 is pivotally connected to the actuating handle 446*a*,446*b* by the pivot 450.

The operation of the oscillating system 410 of FIGS. 6 and 7 is as follows:

The cylinder-and-piston unit 464 is alternately extended and retracted to generate a reciprocating or oscillating motion. This causes the load-bearing member 470 to move back-and-forth since the cylinder-and-piston unit 464 is connected to the actuating handle 446*a*,446*b* which, in turn, is fast with the tube 472 of the load-bearing member 470. Due to the fact that the end plates 478 of the load-bearing member 470 are rigid with the operating levers 436, the load-bearing member 470 rotates the operating levers 436 back-and-forth.

The back-and-forth motion of the operating levers 436 causes the push rods 432, which are pivotally connected to the operating levers 436, to reciprocate longitudinally. As the push rods 432 reciprocate, the lever arms 418 are rotated back-and-forth on the pivots 420 inasmuch as the lever arms 418 are pivotally connected to the push rods 432. The back-and-forth rotation of the lever arms 418 results in an up-and-down motion of the ends of the lever arms 418 remote from the push rods 432. Since such lever arm ends carry the mold table parts 414, the mold table parts 414 are accordingly oscillated.

In addition to being pivotally connected to the push rods 432, the operating levers 436 are fast with the synchronizing member 438. Consequently, the operating levers 436, push rods 432 and lever arms 418 are constrained to move in synchronism thereby causing the mold table parts 414 to oscillate synchronously.

In the oscillating system 410, central loading of the synchronizing member 438 is avoided. This eliminates the need for bearings at the midsection of the synchronizing member 438.

The use of tubes 440 and 472 for the synchronizing member 438 and load-bearing member 470 allows the weight of the oscillating system 410 to be reduced. However, it is possible to replace the tube 440 and/or the tube 472 with a shaft or other component of solid cross section.

The hydraulic cylinder-and-piston unit 464 of the oscillating system 410 can be replaced by the electric motor 154, gear reducer 156, eccentric 152 and push rod 148 of FIG. 2.

Various other modifications are conceivable within the meaning and range of equivalence of the appended claims.

We claim:

1. A continuous casting apparatus comprising:

a mold carrier having two discrete spaced parts;

means for oscillating said parts; and means for synchronizing movement of said parts, said synchronizing means including a synchronizing member which is mounted for movement as a unit and is coupled to said parts in such a manner that said parts are mechanically constrained to move in substantial synchronism.

2. The apparatus of claim 1, further comprising means connecting said synchronizing member to said parts, said connecting means including means for preventing substantial transfer of stresses due to thermal expansion of said parts from said parts to said synchronizing member.

3. The apparatus of claim 1, wherein said synchronizing member comprises a shaft.

4. The apparatus of claim 1, wherein said synchronizing member comprises a tube.

5. The apparatus of claim 1, wherein said synchronizing member is rotatable; and further comprising a journal bearing supporting said synchronizing member.

6. The apparatus of claim 1, wherein said oscillating means comprises a moving member for moving one of said parts, said moving member being coupled to said synchronizing member and to said one part; and further comprising at least one journal bearing supporting said moving member.

7. The apparatus of claim 6, wherein said moving member comprises means for fixing the length of said moving member at any of a plurality of values.

8. The apparatus of claim 1, wherein said oscillating means comprises a generating member for generating oscillating motion for said parts, said generating member constituting the sole means for generating oscillating motion for said parts.

9. The apparatus of claim 8, wherein said generating member comprises a cylinder-and-piston unit.

10. The apparatus of claim 8, wherein said generating member comprises an eccentric.

11. The apparatus of claim 1, wherein said oscillating means is connected to said synchronizing member.

12. The apparatus of claim 11, wherein said oscillating means comprises a pair of spaced operating members fast with said synchronizing member and coupled to respective ones of said parts, and a drive for moving said parts, said synchronizing member including an actuating element coupled to said drive.

13. The apparatus of claim 12, wherein said oscillating means further comprises an arm on each of said parts, and a moving member coupled to each of said arms and to the respective operating member.

14. The apparatus of claim 1, wherein said oscillating means comprises a bridge member coupled to said parts, and a drive for moving said parts coupled to said bridge member.

15. The apparatus of claim 14, wherein said oscillating means further comprises a pair of spaced operating members fast with said synchronizing member and said bridge member and coupled to respective ones of said parts, and an actuating element fast with said bridge member and coupled to said drive.

16. The apparatus of claim 15, wherein said oscillating means further comprises an arm on each of said parts, and a moving member coupled to each of said arms and to the respective operating member.

17. The apparatus of claim 14, wherein said synchronizing member and said bridge member are substantially parallel to one another.

18. The apparatus of claim 1, wherein said oscillating means comprises a generating member for generating oscillating motion for said parts, said synchronizing member being located between said generating member and said parts.

19. The apparatus of claim 2, wherein said preventing means comprises a bearing.

20. A method of oscillating a mold carrier having two discrete spaced parts comprising the steps of:

generating an oscillating motion at a predetermined location;

transferring said motion from said location to said parts; and mechanically constraining said parts to oscillate in substantial synchronism.

21. The method of claim 20, further comprising the step of preventing substantial transfer of stresses due to thermal expansion of said parts from said parts to said location.

22. The method of claim 20, wherein the constraining step is performed using a synchronizing member mounted for movement as a unit and coupled to said parts.

23. The method of claim 20, wherein said location is substantially midway between said parts.

24. The method of claim 22, wherein said motion is advanced from said location to said parts by way of said synchronizing member.

* * * * *